US008556257B2

(12) United States Patent
Mizubata

(10) Patent No.: US 8,556,257 B2
(45) Date of Patent: Oct. 15, 2013

(54) SHEET LOADING DEVICE AND POST-PROCESSING APPARATUS

(75) Inventor: Tsuyoshi Mizubata, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/548,734

(22) Filed: Jul. 13, 2012

(65) Prior Publication Data

US 2013/0020756 A1 Jan. 24, 2013

(30) Foreign Application Priority Data

Jul. 22, 2011 (JP) ..... 2011-161096

(51) Int. Cl.

| | |
|---|---|
| ***B65H 31/26*** | (2006.01) |
| ***B65H 39/10*** | (2006.01) |
| ***B65H 5/00*** | (2006.01) |
| ***B65H 39/00*** | (2006.01) |

(52) U.S. Cl.

USPC ..... 271/220; 271/3.03; 271/303; 271/223; 270/58.07

(58) Field of Classification Search

USPC ..... 271/3.03, 3.04, 220, 303, 223, 224; 270/58.07–58.09, 58.12, 58.17

See application file for complete search history.

(56) References Cited

U.S. PATENT DOCUMENTS

| | | | | |
|---|---|---|---|---|
| 8,087,667 | B2 * | 1/2012 | Sekigawa | 271/220 |
| 8,393,616 | B2 * | 3/2013 | Kubota et al. | 271/220 |
| 8,480,078 | B2 * | 7/2013 | Kubota et al. | 271/220 |
| 2009/0127764 | A1 * | 5/2009 | Kamiya | 270/58.07 |
| 2013/0119604 | A1 * | 5/2013 | Kubota et al. | 271/220 |

FOREIGN PATENT DOCUMENTS

| | | |
|---|---|---|
| JP | 2007-55752 | 3/2007 |
| JP | 2009-120330 | 6/2009 |

* cited by examiner

*Primary Examiner* — Patrick Cicchino
(74) *Attorney, Agent, or Firm* — Morrison & Foerster LLP

(57) ABSTRACT

A sheet loading device that includes a tray having a sheet loading surface, transports sheets one by one to the tray along a transport path, and loads the sheets one by one onto the sheet loading surface, comprising: a guide member for guiding a sheet to the tray along the transport path; a drive member; a restriction member; and a bias mechanism. Along a course of movement for pressing a loaded sheet against the sheet loading surface, the guide member engages with the restriction member, causes the restriction member to move to a position for restricting forming of a curl on the loaded sheet, and thereby prevents the transport path from being blocked by the curl. When the engagement between the guide member and the restriction member is released, the restriction member returns to an initial position by bias force applied by the bias mechanism.

10 Claims, 6 Drawing Sheets

(b)

SHEET LOADING DEVICE AND POST-PROCESSING APPARATUS

This application is based on an application No. 2011-161096 filed in Japan, the contents of which are hereby incorporated by reference.

BACKGROUND OF THE INVENTION (1) Field of the Invention

The present invention relates to a sheet loading device that transports and loads a plurality of recording sheets, one by one, onto a tray included therein and a post-processing apparatus including the sheet loading device.

(2) Description of Related Art

Recently, there are many cases where a post-processing apparatus is attached to and is used in combination with an image forming apparatus such as a copier. Such a post-processing apparatus performs staple processing of stapling recording sheets output from an image forming apparatus and/or other types of processing.

Such a post-processing apparatus includes a sheet loading device that transports and loads a plurality of recording sheets output from an image forming apparatus, one by one, onto a tray included therein. Further, a post-processing apparatus equipped with such a sheet loading device executes staple processing with respect to recording sheets having been loaded onto a tray included therein by utilizing a staple unit included therein. More specifically, such a post-processing apparatus executes staple processing when the number of recording sheets having been loaded onto a tray reaches a specific number specified by a user.

As already explained above, a sheet loading device transports recording sheets one by one onto a tray. Here, problems may arise if a curl is formed on one or more recording sheets already loaded on the tray. When a curl is formed on a recording sheet already loaded on the tray, a rear end of the curled recording sheet may depart from a surface of the tray and block a transport path along which recording sheets are transported to the tray. This leads to recording sheets newly transported to the tray being bent since the rear end of the curled recording sheet departing from the surface of the tray collides with the newly transported recording sheets. In addition, when a curl is formed on a recording sheet that is already loaded on the tray, the order in which recording sheets are loaded onto the tray may be undesirably altered since newly transported recording sheets may slip beneath the curled recording sheet.

So as to provide a measure for preventing such a problem from taking place, Japanese Patent Application Publication No. 2009-120330 (hereinafter referred to as "Patent Literature"), for example, discloses a method where the following procedures are sequentially executed: (i) driving a pressing member so as to press a rear end portion of a recording sheet already loaded on a tray against a sheet loading surface of the tray; (ii) driving a claw member and causing the claw member to engage with the rear end portion of the recording sheet already loaded on the tray so as to restrict the rear end portion from departing from the sheet loading surface; and (iii) causing the pressing member to recede so as to prepare for transportation of a subsequent recording sheet.

Patent Literature indicates that the above-described method realizes: (i) restricting the rear ends of the recording sheets loaded on the tray by driving the claw member; (ii) definitely inhibiting the rear end portions of the recording sheets loaded on the tray from departing from the sheet loading surface; and (iii) thereby ensuring that newly transported recording sheets are smoothly and appropriately loaded onto the tray.

However, according to the method disclosed in Patent Literature, the pressing member and the claw member are driven by separate driving mechanisms, each of which is driven by a separate, independent drive source, partially owing to the pressing member and the claw member being configured to apply pressure on the recording sheets at different, respective timings. This is problematic in that an increase is brought about in the cost of a device performing such a method.

SUMMARY OF THE INVENTION

In view of the above-described problems, the present invention provides a sheet loading device that reduces device cost as much as possible and that smoothly and appropriately loads recording sheets onto a tray included therein by definitely preventing rear end portions of recording sheets loaded on the tray from departing from a surface of the tray, and a post-processing apparatus including the sheet loading device.

A sheet loading device pertaining to a first aspect of the present invention is a sheet loading device that includes a tray having a sheet loading surface, that transports a plurality of recording sheets one by one to the tray along a transport path, and that loads the recording sheets one by one onto the sheet loading surface, the sheet loading device comprising: a guide member configured to be moveable between a first position and a second position, the guide member (i) guiding a recording sheet transported along the transport path to the sheet loading surface when in the first position and (ii) pressing a rear end portion of the recording sheet loaded on the sheet loading surface against the sheet loading surface when in the second position; a drive member that selectively causes the guide member to move between the first position and the second position; a restriction member that is arranged between a surface facing the transport path of the guide member in the first position and the sheet loading surface and that is configured to be moveable between a third position and a fourth position, the restriction member (i) restricting the rear end portion from departing from the sheet loading surface and thus preventing the rear end portion from blocking the transport path when in the third position and (ii) releasing the restriction when in the fourth position; and a bias mechanism configured to apply a bias force to bias the restriction member towards the third position from the fourth position, wherein along a course of movement of the guide member from the first position to the second position, the guide member causes the restriction member to move from the third position to the fourth position by an engaging portion of the guide member engaging with an engaged portion of the restriction member, the engagement between the engaging portion and the engaged portion is released before the guide member arrives at the second position, and when the engagement between the engaging portion and the engaged portion is released, the restriction member is caused to return to the third position by the bias force applied by the bias mechanism.

A post-processing apparatus pertaining to a second aspect of the present invention is a post-processing apparatus that is attached to an image forming apparatus and that includes a sheet loading device, the sheet loading device including a tray having a sheet loading surface, transporting a plurality of recording sheets discharged from the image forming apparatus one by one to the tray along a transport path, loading the recording sheets one by one onto the sheet loading surface, and comprising: a guide member configured to be moveable between a first position and a second position, the guide member (i) guiding a recording sheet transported along the transport path to the sheet loading surface when in the first position and (ii) pressing a rear end portion of the recording sheet loaded on the sheet loading surface against the sheet loading surface when in the second position; a drive member that selectively causes the guide member to move between the first position and the second position; a restriction member that is arranged between a surface facing the transport path of the guide member in the first position and the sheet loading surface and that is configured to be moveable between a third position and a fourth position, the restriction member (i) restricting the rear end portion from departing from the sheet loading surface and thus preventing the rear end portion from blocking the transport path when in the third position and (ii) releasing the restriction when in the fourth position; and a bias mechanism configured to apply a bias force to bias the restriction member towards the third position from the fourth position, wherein along a course of movement of the guide member from the first position to the second position, the guide member causes the restriction member to move from the third position to the fourth position by an engaging portion of the guide member engaging with an engaged portion of the restriction member, the engagement between the engaging portion and the engaged portion is released before the guide member arrives at the second position, and when the engagement between the engaging portion and the engaged portion is released, the restriction member is caused to return to the third position by the bias force applied by the bias mechanism.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENTS

In the following, explanation is provided taking as an example a digital copier having the post-processing apparatus pertaining to the present invention attached thereto.

Figure 1:
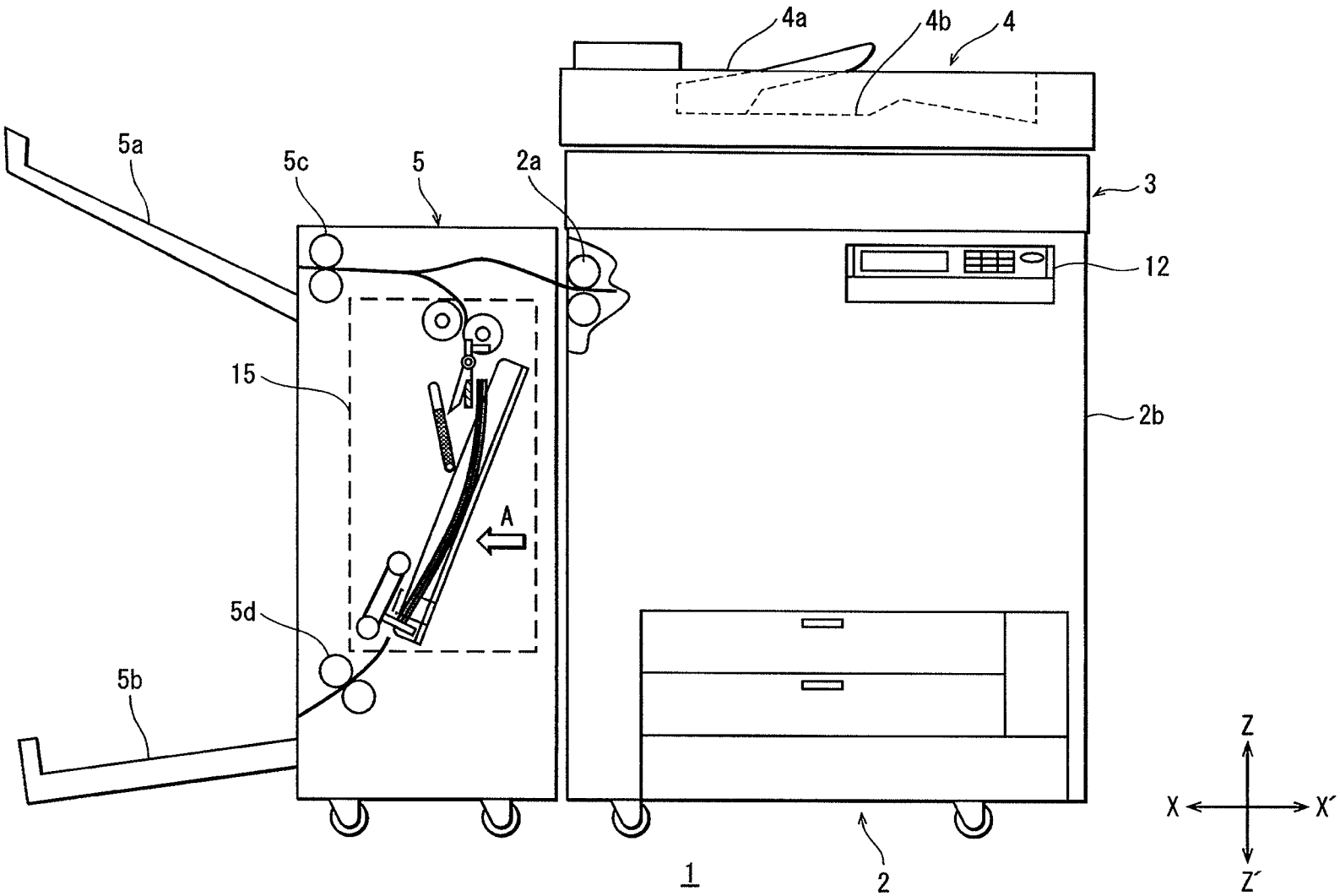
FIG. 1 is a schematic diagram illustrating a structure of a copier having a post-processing apparatus pertaining to an embodiment of the present invention attached thereto.

FIG. 1 is a schematic diagram illustrating a digital copier 1 (hereinafter referred to simply as the "copier 1").

As illustrated in FIG. 1, the copier 1 includes: an image forming apparatus main body 2; and a post-processing unit 5 attached to the left side of the image forming apparatus main body 2 in FIG. 1. The image forming apparatus main body 2 includes: a printer 2*b*; an image reader 3; and a document feeder 4. The image reader 3 and the document feeder 4 are stacked on the printer 2*b* in the stated order.

The document feeder 4 is used to execute image reading according to a so-called sheet-through method. That is, the document reader 4 reads an image on a document placed on a document tray 4*a* by feeding the document to an image reading surface of the image reader 3. Subsequently, the document reader 4 discharges the document whose image has been read to a document discharge tray 4*b*. Further explanation concerning the image reader 3 and the image reading surface is provided in the following.

The image reader 3 has a conventional structure for executing image reading according to the sheet-through method. That is, when performing image reading according to the sheet-through method, the image reader 3 irradiates light towards the image reading surface, causes the light reflected by the document to be received by an undepicted CCD sensor via an optical lens, and thereby generates image data.

The printer 2*b* is a conventional electrophotographic printer. The printer 2*b* performs a sequence of processing, including exposure of a photosensitive drum to light, development, image transfer, and image fixation, and thereby prints the image data output from the image reader 3 onto a recording sheet. Further, the printer 2*b* transfers the recording sheet having an image printed thereon to the post-processing unit 5.

The printer 2*b* is provided with a control panel 12. The control panel 12 includes, for example, a ten-key pad, a liquid crystal display, etc., and has the functions of displaying information to users and receiving instructions from users.

The post-processing unit 5 executes staple processing of stapling recording sheets having been printed by the printer 2*b* according to instructions received from a user via the control panel 12. Following the execution of the staple processing, the post-processing unit 5 discharges the stapled recording sheets to a discharge tray 5*b*.

In specific, when the control panel 12 receives an instruction for executing the staple processing from a user, a portion of recording sheets discharged from the printer 2*b* via a pair of discharge rollers 2*a* is transported to a post-processing section 15 of the post processing unit 5. Here, the transportation of the recording sheets to the post-processing section 15 is performed, for instance, by reversing the rotation of a pair of discharge rollers 5*c* included in the post-processing unit 5 at a timing when the recording sheets are drawn into the pair of discharge rollers 5*c* and thereby causing the recording sheets to be switched back and transported to the post-processing section 15.

As a matter of course, recording sheets may be directly transported to the post-processing section 15 without being switched back in the above-described manner.

The post-processing section 15 executes the staple processing of stapling together a stack of recording sheets loaded on the tray and discharges the stapled stack of recording sheets to the discharge tray 5*b* via a pair of discharge rollers 5*d*.

Here, when a user instruction for executing the staple processing is not received, the recording sheets discharged from the printer 2*b* are discharged as-is to a discharge tray 5*a*.

Figure 2:
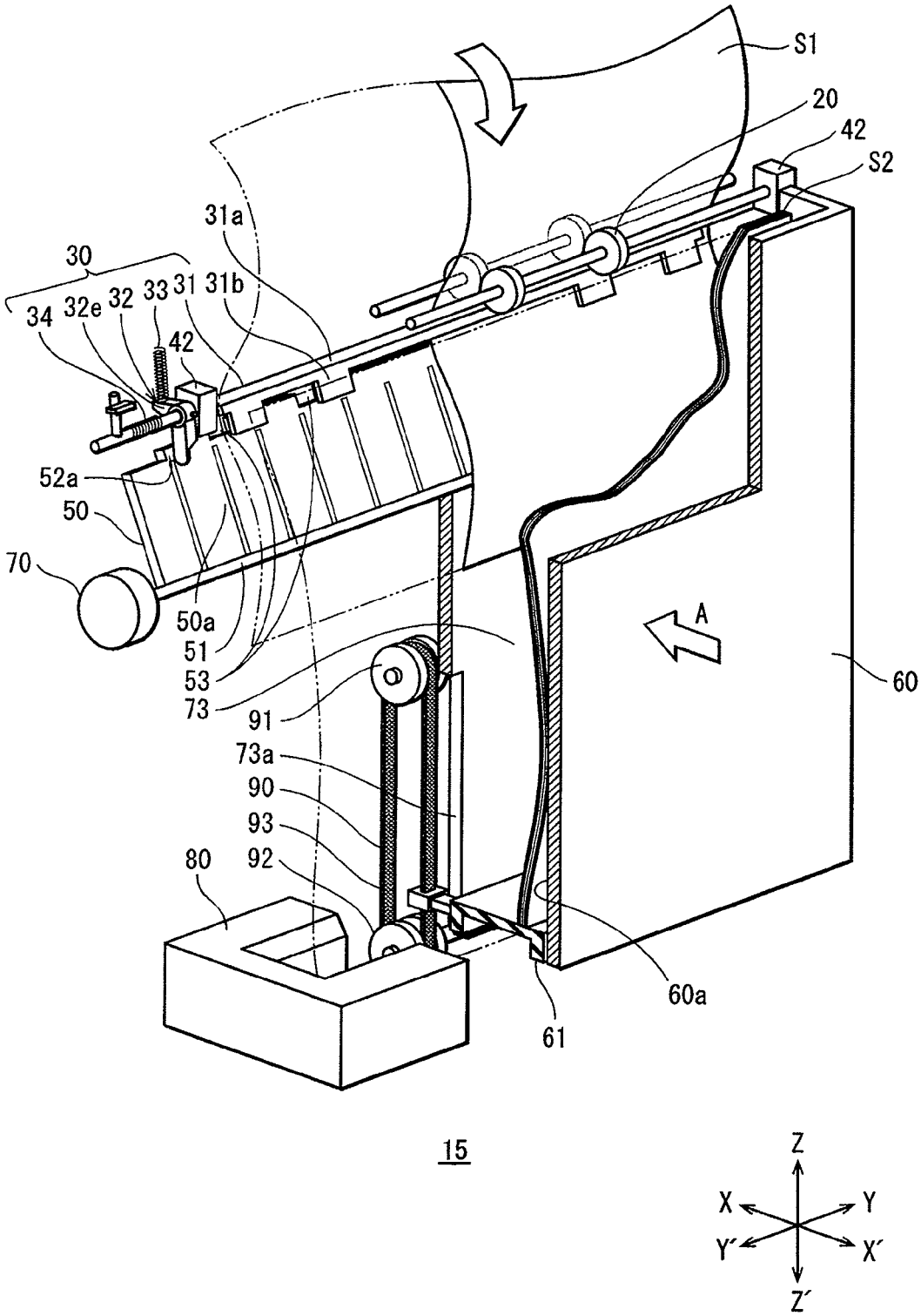
FIG. 2 is a partially cut-out perspective view illustrating the structure of the post-processing apparatus.

FIG. 2 is a partially cut-out perspective view illustrating a structure of the post-processing section 15.

As illustrated in FIG. 2, the post-processing section 15 includes: a pair of transport rollers 20; a rear end restriction unit 30 (corresponding to the restriction member); a guide member 50; a tray 60; a staple unit 80; a drive unit 70; and a drive unit 90.

The pair of transport rollers 20 is composed of a first transport roller that is driven by an undepicted drive source and a second transport roller that is caused to passively rotate by the rotation of the first transport roller. The pair of transport rollers 20 transports a recording sheet S1 having been switched back by the pair of discharge rollers 5*c* to the tray 60.

The guide member 50 is a plate-like member that is elongated in the Y axis direction in FIG. 2 and that is swingably supported by an undepicted bearing via a rotational shaft 51. The bearing is provided to a frame of a main body of the post-processing unit 5 and the rotational shaft 51 is attached to a lower side edge portion of the guide member 50 (an edge portion in the Z' direction in FIG. 2).

Further, the guide member 50 is swingably driven by one end of the rotational shaft 51 being attached to the drive unit 70. A motor having a controllable rotation angle such as a stepping motor is desirable as a drive source of the drive unit 70.

In addition, the guide member 50 is provided with a guide surface 50*a* at a surface thereof facing the tray 60. The guide surface 50*a* guides the recording sheet S1 transported by the pair of guide rollers 20 to the tray 60.

Further, an engaging portion 52*a* and four cut-out portions 53 are formed at an end portion of the guide member 50 (an end portion in the Z direction in FIG. 2), which is located opposite the lower side edge portion to which the rotational shaft 51 is attached. The engaging portion 52*a* is formed further in the Y' direction than the four cut-out portions 53, and the four cut-out portions 53 are formed along the Y axis direction with predetermined intervals therebetween (note that only two of the four cut-out portions 53, which are further in the Y' direction than the two other cut-out portions, are illustrated in FIG. 2)

The cut-out portions 53 are provided so as to prevent the guide member 50 from interfering with tongue portions 3 lb of a rear end restriction member 31 of the rear end restriction unit 30 when the rear end restriction unit 30 performs a movement of pressing rear ends of recording sheets. Explanation concerning the movement of the rear end restriction unit 30 of pressing rear ends of recording sheets is provided in the following.

The rear end restriction unit 30 restricts a rear end portion (an end portion closer to the pair of transport rollers 20) of a recording sheet loaded on the tray 60 from departing from a sheet loading surface of the tray 60 due to a curl being formed on the recording sheet. Detailed explanation concerning the rear end restriction unit 30 is provided in the following.

The tray 60 receives a plurality of recording sheets that are loaded one by one onto a sheet loading surface 60*a* and thereby holds the recording sheets such that front end portions (end portions located farther from the pair of guide rollers 20) of the recording sheets are aligned. Further, the tray 60 is provided with a bottom plate 61 at a lower end thereof (an end in the Z' direction). The bottom plate 61 adjusts the positions of the front end portions of the recording sheets.

The bottom plate 61 is driven by the drive unit 90 so as to ascend/descend. By causing the bottom plate 61 to ascend/descend in such a manner, it is ensured that a rear end of a stack of recording sheets S2 is in contact with the tongue portions 31*b* of the rear end restriction member 31 regardless of the sheet size of the recording sheets composing the recording sheet stack S2. Thus, even when curls are formed in the recording sheets composing the recording sheet stack S2, the rear ends of the recording sheets are restricted from departing further from the sheet loading surface 60*a* of the tray 60. In specific, the height of the bottom plate 61 is adjusted by causing the bottom plate 61 to ascend/descend and such that the rear ends of the recording sheets face the tongue portions 31*b* of the rear end restriction member 31.

In addition, the bottom plate 61 is configured to recede towards the outside of the tray 60 so as to discharge a recording sheet stack having undergone staple processing from a bottom portion of the tray 60.

The drive unit 90 includes: a drive roller 91 that is rotatably driven by an undepicted drive source; a passive roller 92 provided so as to be rotatable; and an endless belt wound around and bridged between the drive roller 91 and the passive roller 92. The endless belt 93 is fixed to the bottom plate 61 of the tray 60 such that the bottom plate 61 maintains a substantially perpendicular angle with respect to a driving direction of the endless belt 93 and such that the bottom plate 61 is caused to ascend/descend or recede in the above-described manner when the endless belt 93 rotates.

The staple unit 80 performs staple processing of stapling together the recording sheet stack S2 loaded on the tray 60 at one corner of the front end portion of the recording sheet stack S2. Here, the stapling by the staple unit 80 is performed with respect to a Y' direction corner of the front end portion of the recording sheet stack.

Alternatively, the staple unit 80 may be provided with a movement mechanism allowing the staple unit 80 to move in a vertical direction of the tray 60 so as to staple two portions along an edge of a Y' direction side of the recording sheet stack S2. Detailed explanation concerning the staple unit 80 is omitted herein since the staple unit 80 itself has a conventional structure.

The recording sheet stack having been stapled together by the post-processing section 15 is discharged from the post-processing section 15 by the bottom plate 61 receding towards the outside of the tray 60. Further, the recording sheet stack discharged from the post-processing section 15 is discharged onto the discharge tray 5*b* via the pair of discharge rollers 5*d*.

<Structure of Rear End Restriction Unit>

As described above, the rear end restriction unit 30 restricts a rear end portion (an end portion closer to the pair of transport rollers 20) of a recording sheet loaded on the tray 60 from departing from the sheet loading surface 60*a* of the tray 60 due to a curl being formed on the recording sheet. The rear end restriction unit 30 includes: the rear end restriction member 31; an engaged lever 32; a bias member 33; a position retention member 34, etc.

The rear end restriction member 31 includes: a rotational shaft 31*a* elongated in the Y axis direction; and the four tongue portions 31*b* commonly extending in one direction perpendicular to the rotational shaft 31*a*. The rotational shaft 31*a* is supported so as to be rotatable by the undepicted frame of the main body of the post-processing unit 5 via a shaft supporting member 42.

The engaged lever 32 is attached to the rotational shaft 31*a* at one of the ends of the rotational shaft 31 that is further in the Y' direction. The engaged lever 32 engages with the engaging portion 52*a* of the guide member 50 and thereby causes the rear end restriction member 31 to swing towards the tray 60. More specifically, the engaging portion 52*a* of the guide member 50 comes into contact with the engaged lever 32 as the guide member 50 swings towards the tray 60.

Figure 3:
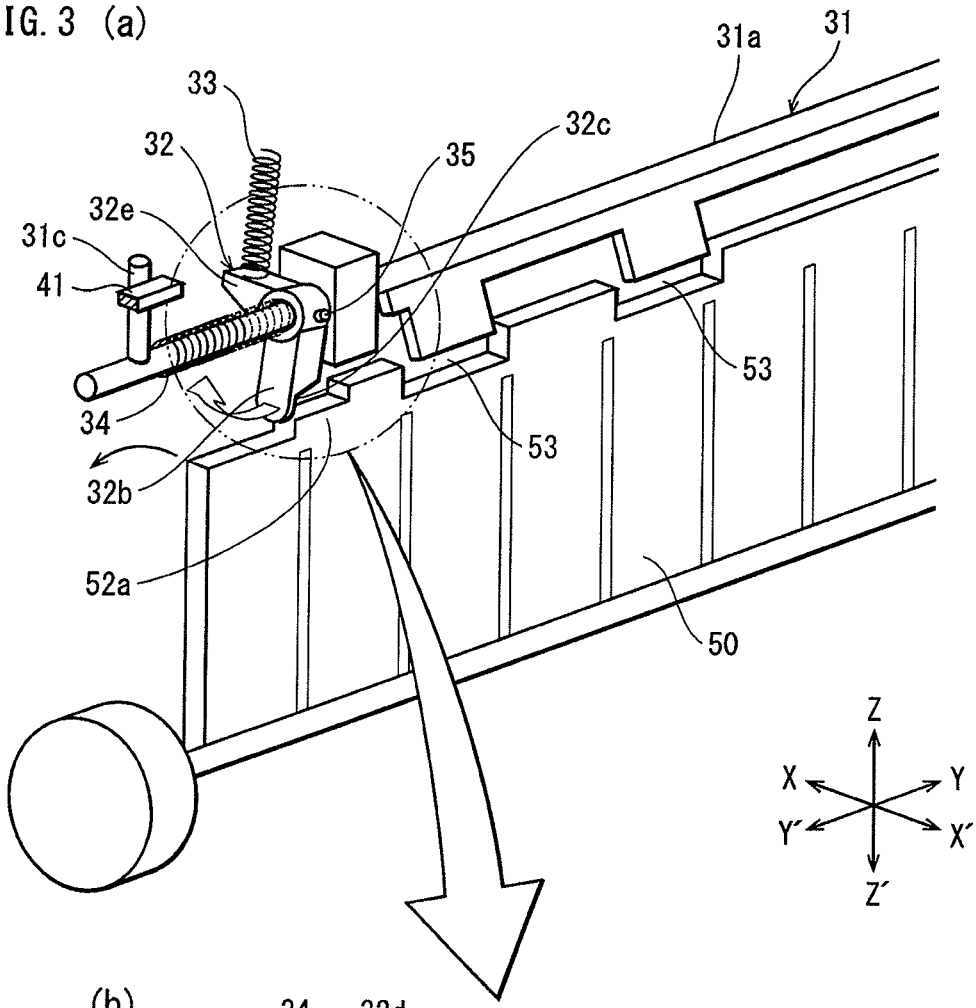
FIG. 3 is an enlarged view illustrating a main part of the post-processing apparatus.
Figure 3:
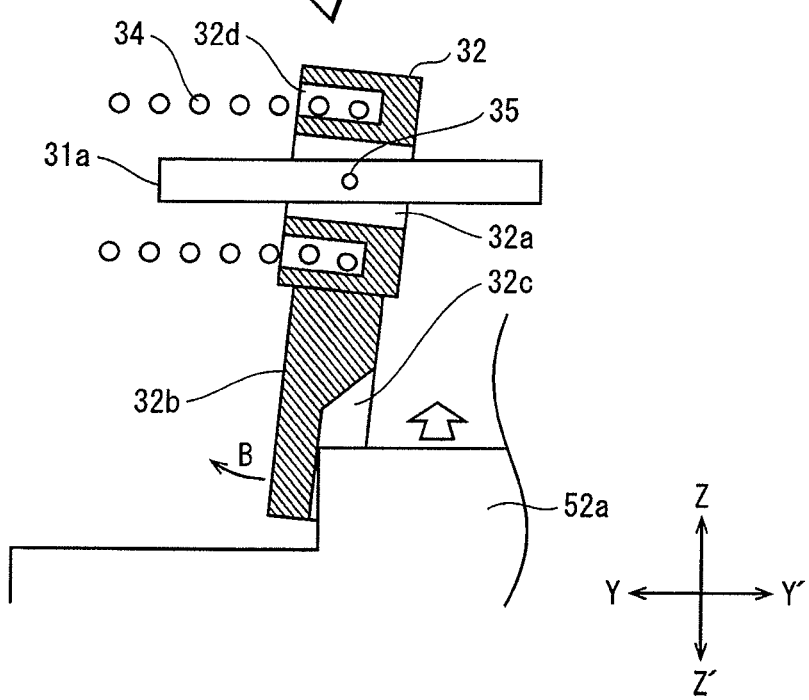

Portion (a) of FIG. 3 is an enlarged perspective view illustrating a periphery of the engaged lever 32. Portion (b) of FIG. 3 is a cross-sectional view illustrating a cross section of the engaged lever 32 taken along one plane including an axial center of the rotational shaft 31*a*.

The engaged lever 32 includes: a lever portion 32*b*; and an arm portion 32*e*. The lever portion 32*b* and the arm portion 32*e* are perpendicular to each other, and thus, the engaged lever 32 exhibits an inverted L shape as illustrated in portion (a) of FIG. 3.

Here, bias force is applied to the arm portion 32*e* in the Z direction in portion (a) of FIG. 3 by the bias member 33, which provides the engaged lever 32 with a moment of rotation to swing about the rotational axis 31*a* in the clockwise direction. In specific, the bias member 33 is a helical tension spring or the like.

Alternatively, an elastic member formed by using rubber, resin or the like may be used as the bias member 33 instead of a helical tension spring.

Further, an engagement pin 31*c* is vertically provided to a portion of the rotational shaft 31*a* that lies further in the Y' direction than the portion of the rotational shaft 31*a* to which the engaged lever 32 is attached. That is, the engagement pin 31*c* is arranged so as to stand in a direction perpendicular to the rotational shaft 31*a*. Further, the engagement pin 31*c* falls in contact with a stopper 41 provided to the frame of the main body of the post-processing unit 5 (undepicted) when the rear end restriction member swings in a direction away from the tray 60 and thereby restricts the swing angle of the rear end restriction member 31 in this direction.

In addition, as illustrated in the cross-sectional view in portion (b) of FIG. 3, the engaged lever 32 is attached to the rotational shaft 31*a* of the rear end restriction member 31 by a support pivot pin 35 retaining the engaged lever 32 in a swingable manner to the rotational shaft 31*a* while the rotational shaft 31*a* is freely fit into a through-hole 32*a* provided in the engaged lever 32.

Further, as illustrated in portion (b) of FIG. 3, the engaged lever 32 has a groove portion 32*d* which receives an end portion of the position retention member 34. The position retention member 34 is composed of a compression coil spring and has an adequate degree of stiffness. Hence, when in an initial state, the engaged lever 32 is retained at a predetermined position where a long side direction of the lever portion 32*b* is perpendicular with the rotational shaft 31*a* by the position retention member 34 having an adequate degree of stiffness being inserted into the groove portion 32*d*.

Note that in portion (a) of FIG. 3, the entirety of the compression coil spring composing the position retention member 34 is not illustrated for the sake of facilitating understanding of the shape of the engaged lever 32. However, the compression coil spring is actually provided so as to extend from the engagement pin 31*c* to the groove portion 32*d* of the engaged lever 32.

Two sides of the lever portion 32*b* engage with the engaging portion 52*a* of the guide member 50. In specific, the lever portion 32*b* engages with the engaging portion 52*a* at one side in the X direction in portion (a) of FIG. 3 and another side in the X' direction in portion (a) of FIG. 3. The side of the lever portion 32*b* in the X direction exhibits a planar surface parallel to the elongated direction of the rotational shaft 31*a*. In contrast, a portion of the side of the lever portion 32*b* in the X' direction that comes in contact with the engaging portion 52*a* is a tapered portion 32*c*. In specific, the tapered portion 32*c* has a tapered shape such that the thickness thereof along the X axis direction gradually decreases towards the Y direction as illustrated in FIG. 3. Further, as illustrated in portion (a) of FIG. 3, when the guide member 50 swings in a direction away from the tray 60 and the engaging portion 52*a* of the guide member 50 comes into contact with the tapered portion 32*c* while the engagement pin 31*c* is in contact with the stopper 41, the lever portion 32*b* tilts in the direction indicated by an arrow B in portion (b) of FIG. 3. In specific, when the engaging portion 52*a* comes into contact with the side of the lever portion 32*b* facing the X' direction in portion (a) of FIG. 3, the tapered portion 32*c* generates force that presses the lever portion 32*b* in a direction parallel to the rotational shaft 31*a* due to a taper effect. Accordingly, the lever portion 32*b* tilts in the Y axis direction while overcoming the force applied thereto by the position retention member 34.

As a result of the lever portion 32*b* tilting in the direction indicated by the arrow B in portion (b) of FIG. 3, engagement between the engaging portion 52*a* and the lever portion 32*b* is avoided. Hence, the guide member 50 continues to swing in the X direction independently and accordingly returns to an initial position (the first position).

Figure 4:
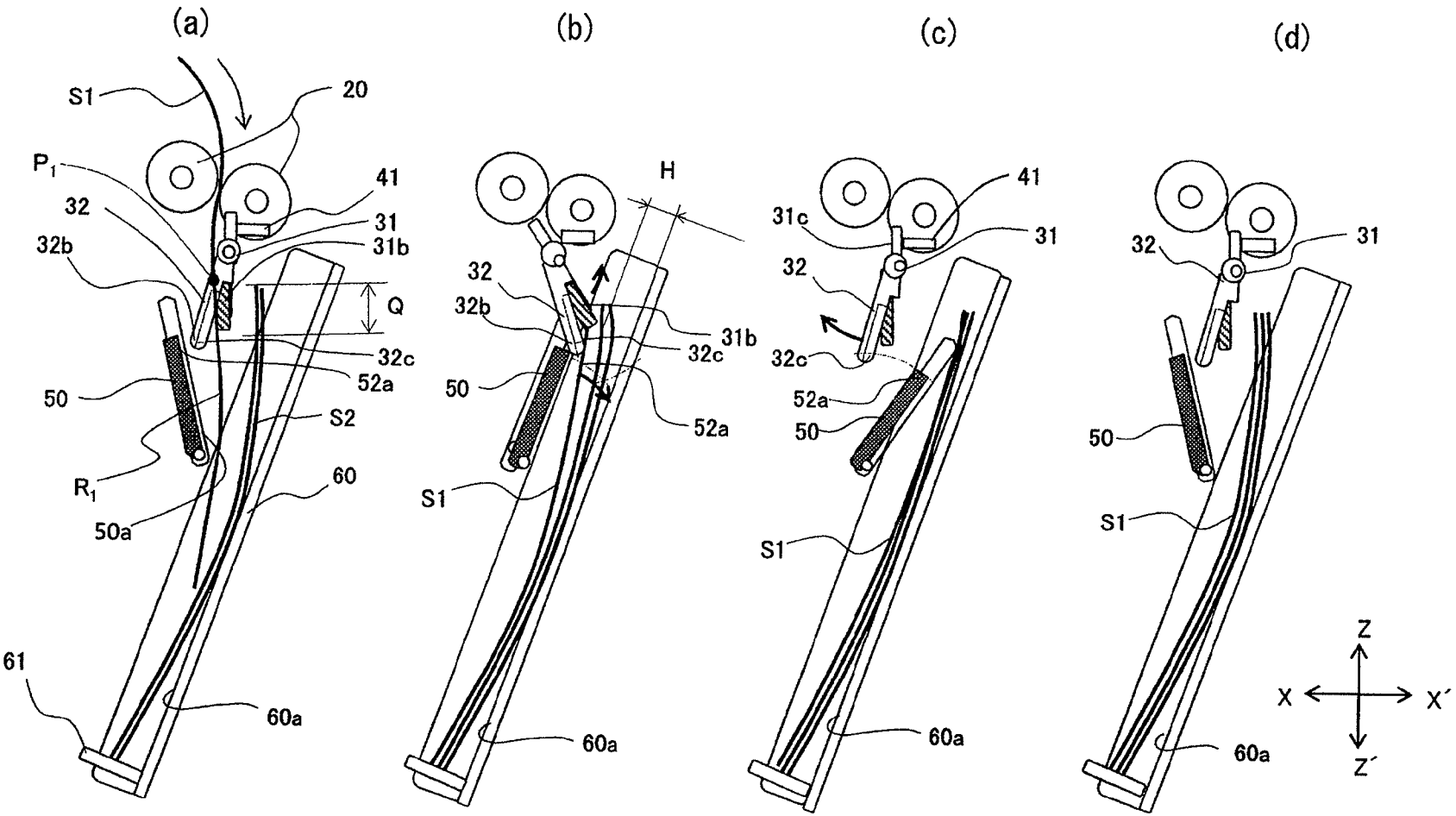
FIG. 4 illustrates operational states of the post-processing apparatus.

FIG. 4 illustrates operational states of components included in the post-processing section 15.

As illustrated in portion (a) of FIG. 4, in an initial state of the post-processing section 15, the guide member 50 is located at a position (hereinafter referred to as a "guide reference position") that is in the X direction side of a path R1 (hereinafter referred to as a "transport path R1") along which the recording sheet S1 is transported through the pair of transport rollers 20.

On the other hand, when the guide member 50 is located at the guide reference position, the rear end restriction member 31 is located at a position (hereinafter referred to as a "restriction position") that is between a guiding surface 50*a* of the guide member 50 and the sheet loading surface 60*a* of the tray 60 as illustrated in portion (a) of FIG. 4.

When the guide member 50 and the rear end restriction member 31 are respectively located at the guide reference position and the restriction position, the recording sheet S1 transported through the pair of guide rollers 20 is guided towards the tray 60 by the guiding surface 50*a* of the guide member 50. When the recording sheet S1 is guided towards the tray 60 while the guide member 50 and the rear end restriction member 31 are respectively located at the guide reference position and the restriction position, the rear end restriction member 31 prevents a rear end portion Q of the recording sheet stack S2 already loaded on the tray 60 from blocking a point P1 along the transport path R1 by restricting the rear end portion Q from departing from the sheet loading surface 60*a*.

Here, it is further desirable that, when viewed from a direction perpendicular to the sheet resting surface 60*a* in portion (a) of FIG. 4, the rear end restriction member 31 be provided such that, when in the restriction position, the rear end restriction member 31 overlaps with the rear end portion Q of the recording sheet stack S2. By arranging the rear end restriction member 31 in such a manner, the rear end restriction member 31 definitely prevents the rear end portion Q of the recording sheet stack S2 from blocking the transport path R1 even when relatively great curls are formed on the recording sheets composing the recording sheet stack S2 already loaded on the tray 60.

When the transportation of the recording sheet S1 is completed, the drive unit 70 (illustrated in FIG. 2) causes the upper end portion of the guide member 50 to swing in the X' direction as illustrated in portion (b) of FIG. 4.

Figure 5:
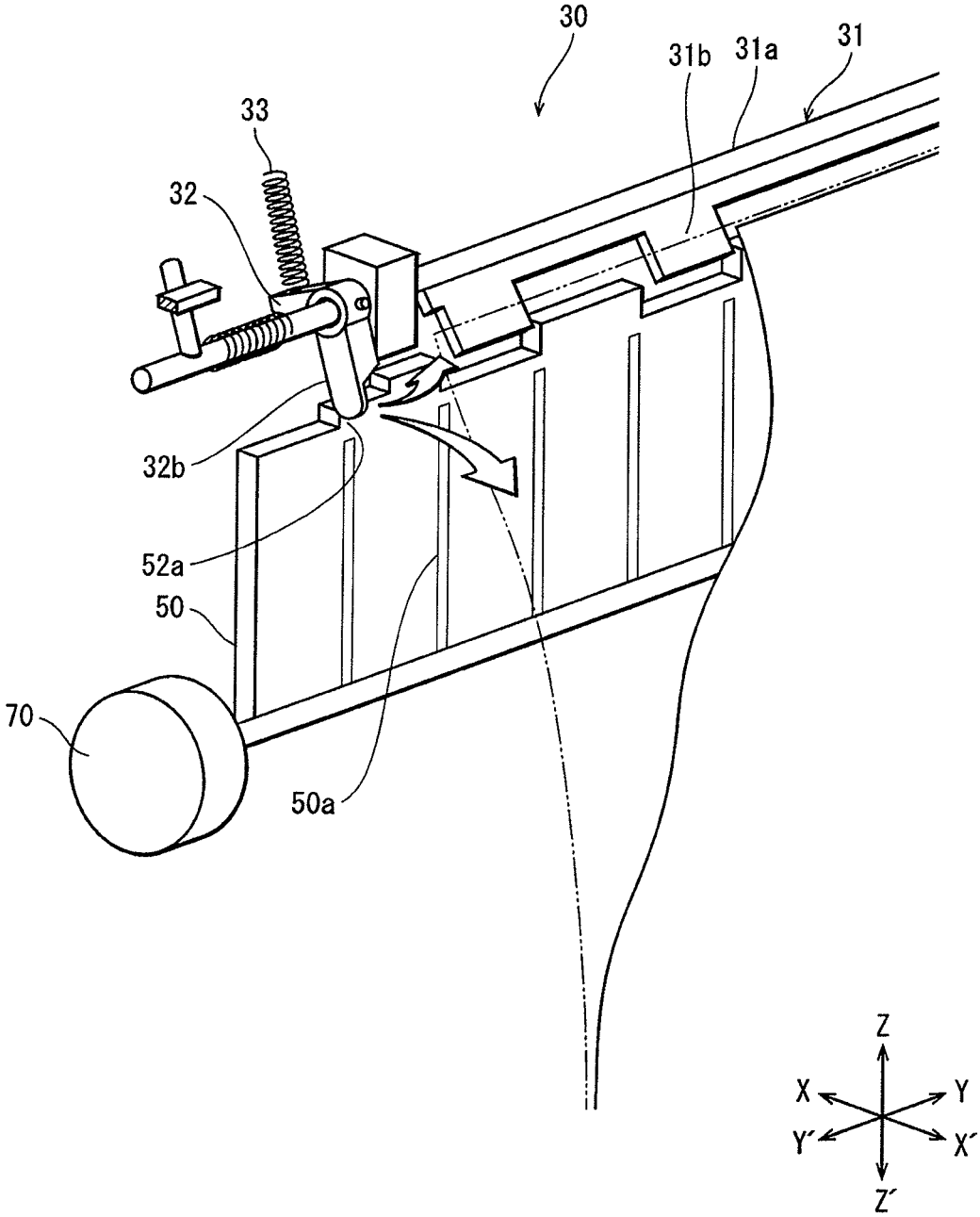
FIG. 5 is an enlarged view illustrating a main part of the post-processing apparatus.

When the upper end of the guide member 50 swings in the X' direction as described above, the engaging portion 52*a* of the guide member 50 swings while engaging with the lever portion 32*b* as illustrated in FIG. 5. Accordingly, the tongue portions 31*b* of the rear end restriction member 31 swing in the X' direction in conjunction with the guide member 50.

As such, the tongue portions 31*b* of the rear end restriction member 31 swing in the counter-clockwise direction as illustrated in portion (b) of FIG. 4. Further, when the swinging of the guide member 50 progresses and accordingly, the swinging of the rear end restriction member 31 progresses, the engagement between the tongue portions 31*b* and the rear end portion Q of the recording sheet stack S2 loaded on the tray 60 is released at a certain point. At this point, the rear end restriction member 31 releases the restriction imposed on the rear end portion Q of the recording sheet stack S2, and the newly transported recording sheet S1 is placed on the recording sheet stack S2 on the tray 60.

In specific, as the swinging of the guide member 50 progresses and the swinging of the rear end restriction member 31 accordingly progresses, (i) a distance between a portion of the engaging portion 52*a* of the guide member 50 engaging with the lever portion 32*b* and the rotational center of the guide member 50 increases, and (ii) a distance between a portion of the lever portion 32*b* engaging with the engaging portion 52*a* of the guide member 50 and the rotational center of the lever portion 32*b* increases. Further, the engagement between the engaging portion 52*a* of the guide member 50 and the lever unit 32*b* is released immediately when the entirety of the newly transported recording sheet S1 overlaps with the recording sheet stack S2 on the tray 60. Note that the positional arrangements and the lengths of the guide member 50 and the lever portion 32*b* are set so as to realize such movements as described above.

When the engagement between the engaging portion 52*a* of the guide member 50 and the lever portion 32*b* is released in the above-described manner, the rear end restriction member 31 is caused to return to the restriction position by the bias force applied thereto by the bias member 33 (portion (c) of FIG. 4).

Here, given that the height of the recording sheets with respect to the sheet loading surface 60*a* is H mm when a maximum number of recording sheets assumed is transported to the tray 60, the above-described engagement between the engaging portion 52*a* of the guide member 50 and the lever portion 32*b* is required to be released before a minimum distance between the rear end restriction member 31 and the sheet loading surface 60*a* falls equal to or smaller than H mm.

This is since, if the rear end restriction member 31 comes into contact with the recording sheet stack S2 loaded on the tray 60 before the above-described engagement between the engaging portion 52*a* of the guide member 50 and the lever portion 32*b* is released, the release of the engagement would become impossible due to the lever portion 32*b* not being able to swing further.

Following the release of the engagement between the engaging portion 52*a* of the guide member 50 and the lever portion 32*b*, the guide member 50 continues to swing and thereby presses the rear end portion of the recording sheet S1 against the recording sheet stack S2.

Subsequently, the drive unit 70 (illustrated in FIG. 2) rotates in a reverse direction and causes the upper end portion of the guide member 50 to swing in the X direction. Accordingly, the guide member 50 returns to the above-described guide reference position (portion (d) of FIG. 4).

During the return to the guide reference position, the engaging portion 52*a* of the guide member 50 comes into contact with the tapered portion 32*c* of the lever portion 32*b*. However, even when the engaging portion 52*a* comes into contact with the lever portion 32*b* in such a manner, engagement between the engaging portion 52*a* and the lever portion 32*b* is avoided since the lever portion 32*b* tilts in the direction of the rotational shaft 31*a* as explained with reference to FIG. 3. Hence, the guide member 50 can continue to swing in the X axis direction independently (refer to FIG. 3).

Following this, when the guide member 50 returns to the guide reference position, the drive unit 70 stops the drive of the guide member 50.

Alternatively, the return of the guide member 50 to the guide reference position may be realized (i) by setting the rotation amount of the drive member 70 for causing the guide member 50 to return to the guide reference position to an amount that is greater than actually required, (ii) by causing the guide member 50 to definitely come in contact with an undepicted stopper, and (iii) thereby stopping the swinging of the guide member 50 in the X direction.

Further, the movement of the guide member 50 illustrated in portions (a) through (c) of FIG. 4 can be alternatively realized by making the following configurations. That is, such a movement can be realized without the need of detecting the position of the guide member 50 (i) by resetting a count of a drive pulse of the drive unit 70 to zero every time the guide member 50 returns to the guide reference position and (ii) by applying, to the drive unit 70, a number of drive pulses sufficient to cause the guide member 50 to reach and come into contact with the sheet resting surface 60*a* of the tray 60 from the guide reference position.

As a matter of course, a home position sensor composed of, for example, a reflection type optical sensor or the like may be provided so as to detect that the guide member 50 is in the guide reference position.

As explanation has been provided up to this point, it is possible to ensure that rear end portions of recording sheets loaded on a tray are within a predetermined height with respect to a sheet loading surface of the tray by causing a guide member to swing by using a single drive source and by causing an engaging lever to move in conjunction with the guide member at an appropriate timing. As such, new recording sheets can be smoothly transported to the tray without being blocked. Further, the application of such a structure realizes a considerable reduction in manufacturing cost.

<Modifications>

Although description has been made in the above focusing on one embodiment which is an exemplary embodiment of the present invention, it is to be understood that the present invention is not limited to the specific embodiment thereof, and modifications as introduced below can be made without departing from the spirit and scope thereof.

(1) In the above-described embodiment, explanation has been provided that the guide member 50 is a plate-like member elongated in the Y axis direction in FIG. 2. However, the present invention is not limited to this, and the guide member 50 may have any shape, provided that the guide member 50 is able to guide and transport recording sheets to the tray and also press transported recording sheets against the tray.

(2) In the above-described embodiment, explanation has been provided that the rear end restriction member 31 is retained at the predetermined position when in the restriction position by the engagement pin 31*c* coming into contact with the stopper 41 provided to the main body of the post-processing unit 5. However, the present invention is not limited to this.

For instance, in the above-described embodiment, the bias member 33 is connected to the engaged lever 32 at a position of the engaged lever 32 located slightly distant from the rotational shaft 31*a* in the X direction in FIG. 5. However, instead of retaining the rear end restriction member 31 at the predetermined position by providing the bias member 33, the same effect can be realized (i) by providing the engaged lever 32 with a substantially I character shape when viewed from the Y axis direction in FIG. 5, and (ii) by providing a bias member such as a spring that pulls the engaged lever 32 from immediately above. By making such a configuration, the engaged lever 32 can be retained in a position along the Z axis in FIG. 5 at the restriction position by bias force applied by the above-described bias member.

When restraining the rear end restriction member 31 at the predetermined position in the restriction position by applying such a structure, the stopper 41 becomes unnecessary.

Further, when such a structure is applied, the structure of the rear end restriction member 31 explained with reference to FIG. 3, where the engaged lever 32 tilts in the Y axis direction and where the position retention member 34 is provided, is no longer required. Alternatively, the same effects can be realized by merely providing, to the rear end restriction member 31, a portion protruding from the rotational shaft 31*a* in the Z' direction in FIG. 3 instead of the engaged lever 32.

This is since, even when the guide member 50 comes into contact with the rear end restriction member 31 during the return to the guide reference position, the guide member 50 pushes the rear end restriction member 31 in the X direction in FIG. 3 and accordingly, the guide member 50 and the rear end restriction member 31 swing in conjunction. Hence, the rear end restriction member 31 does not prevent the guide member 50 from returning to the guide reference position. Further, the rear end restriction member 31 can also be caused return to the restriction position by making a configuration such that (i) an overlap amount between the contacting portions of the guide member 50 and the rear end restriction member 31 decreases and accordingly, (ii) the contact between the guide member 50 and the rear end restriction member 31 is released before the guide member 50 reaches the guide reference position. Hence, a similar function as the post-processing section 15 explained in the above-described embodiment can be realized.

(3) In the above-described embodiment, explanation has been provided of a structure where the guide member 50 and the rear end restriction member 31 move in a swinging motion. However, the present invention is not limited to this.

Alternatively, a guide member and a rear end restriction member may be caused, for instance, to move in a sliding motion.

Figure 6:
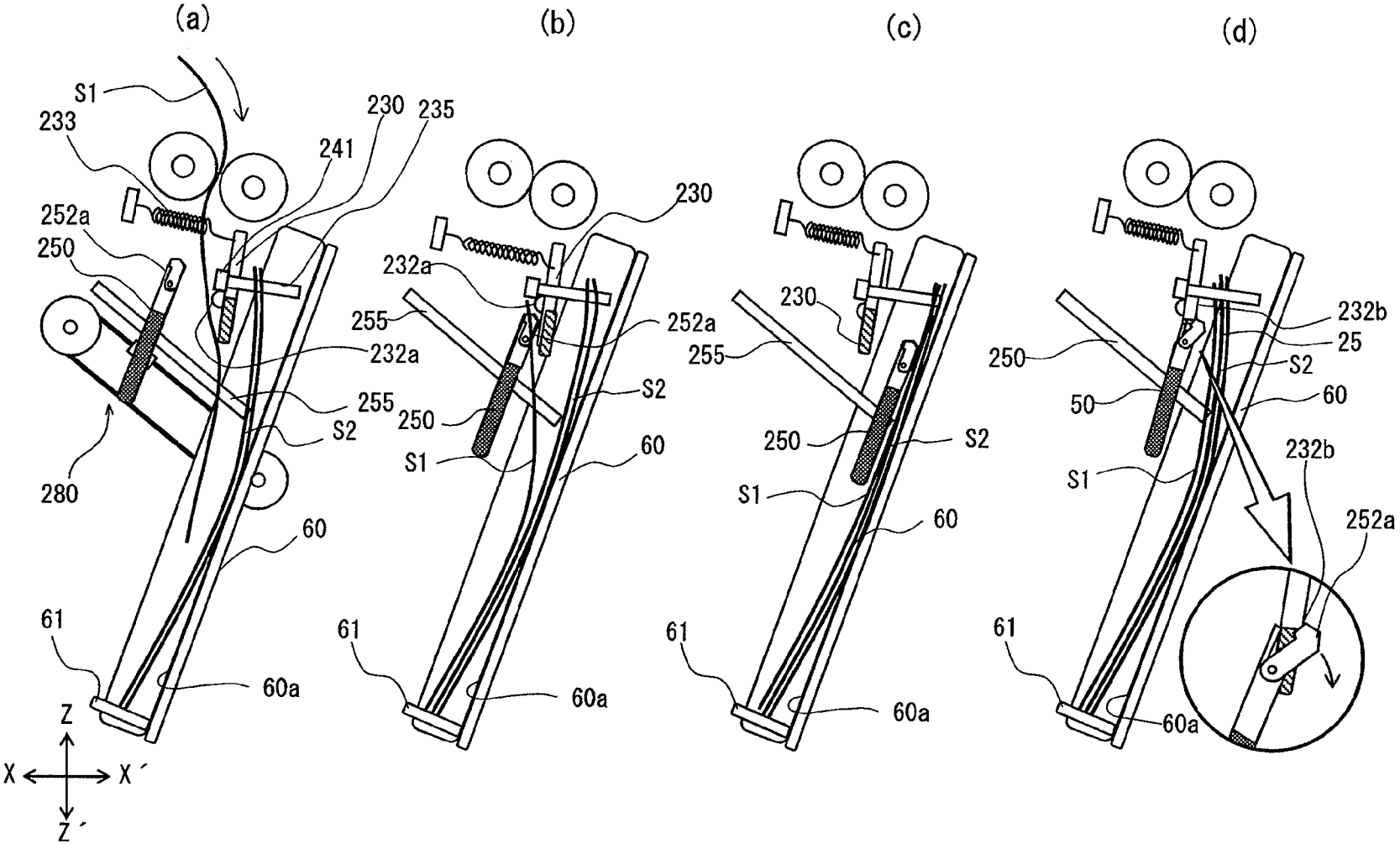
FIG. 6 illustrates operational states of a post-processing apparatus pertaining to a modification of the present invention.

FIG. 6 illustrates operational states of components included in a post-processing section 115 having a structure where a guide member and a rear end restriction member move in a sliding motion.

First, explanation is provided of each of the components of the post-processing section 115 with reference to portion (a) of FIG. 6.

Note that components of the post-processing section 115 similar to the components included in the post-processing section 15 in the above-described embodiment are provided with the same reference signs. Further, explanation is provided in the following mainly focusing on components of the post-processing section 115 that differ from the components included in the post-processing section 15.

As illustrated in portion (a) of FIG. 6, the post-processing section 115 includes: a rail 235; and a rail 255. The rail 235 and the rail 255 are arranged such that a distance therebetween increases as approaching the X' direction in portion (a) of FIG. 6.

Further, a rear end restriction member 230 and a guide member 250 are slidably attached to the rail 235 and the rail 255, respectively.

In addition, a stopper 241 is provided to an end portion of the rail 235 in the X axis direction in portion (a) of FIG. 6. The stopper 241 comes into contact with the rear end restriction member 230 and thereby restricts the position of the rear end restriction member 230.

Further, a bias member 233 composed of a spring, rubber, or the like is attached to the rear end restriction member 230 so as to apply bias force to the rear end restriction member 230 towards the stopper 241.

Further, a drive unit 280 composed of a belt drive mechanism or the like is provided to the post-processing section 115 so as to cause the guide member 250 to move along the rail 255.

The position of the rear end restriction member 230 in portion (a) of FIG. 6 is substantially similar to the position of the rear end restriction member 31 in portion (a) of FIG. 4, and is referred to as the restriction position. Similarly, the position of the guide member 250 in portion (a) of FIG. 6 is substantially similar to the position of the guide member 50 in portion (a) of FIG. 4, and is referred to as the guide reference position.

When the guide member 250 slides in the X' direction from the guide reference position, the recording sheet S1 is pressed towards the sheet resting surface 60*a* of the tray 60. In addition, when the guide member 250 reaches the position indicated in portion (b) of FIG. 6, the guide member 250 comes in contact with the rear end restriction member 230 and causes the rear end restriction member 230 to slide in the X' direction.

As explanation has been provided above, the rail 235 and the rail 255 are arranged such that the distance therebetween increases as approaching the X' direction. Hence, an overlap amount between the contacting portions of the rear end restriction member 230 and the guide member 230 gradually decreases until the above-described contact between the rear end restriction member 230 and the guide member 250 is released. When the contact has been released, the rear end restriction member 230 is caused to individually return to the restriction position as illustrated in portion (c) of FIG. 6 by the bias force being applied by the bias member 233.

On the other hand, the guide member 250 continues to slide in the X' direction as illustrated in portion (c) of FIG. 6 and presses the rear end portion of the recording sheet S1 against the recording sheet stack S2.

Following this, the drive unit 280 is caused to drive in the reverse direction, and accordingly, the guide member 250 is caused to slide in the X direction. Hence, the guide member 250 returns to the guide reference position.

During the return to the guide reference position, the guide member 250 comes into contact with the rear end restriction member 230, which is located at the restriction position at this point. Engagement between the guide member 250 and the rear end restriction portion 230 is prevented from occurring by configuration being made as described in the following. One of the contacting portion of the guide member 250 and the contacting portion of the rear end restriction member 230, e.g. a contact portion 252*a* of the guide member 250, is provided so as to be swingable only when force in the clockwise direction is applied thereto. The force in the clockwise direction is applied by a contact portion 232*b* of the rear end restriction member 230 coming into contact therewith as illustrated in portion (d) of FIG. 6. Hence, the guide member 250 is able to continue sliding further in the X direction individually.

Note that in the above-described structure, the contact portion 252*a* returns to an initial position thereof when the above-described contact is released. More specifically, an undepicted spring continuously applies bias force to the contact portion 252*a* and urges the contact portion 252*a* to swing in a counter-clockwise direction.

As explanation has been provided in the above, the present invention may be applied not only to a structure where the rear end restriction member and the guide member move in a swinging motion, but also to a structure where the rear end restriction member and the guide member move in a sliding motion.

(4) In the above-described embodiment, explanation has been provided taking as an example a case where the post-processing unit 5 (post-processing apparatus) pertaining to the present invention is applied to a digital copier. However, the present invention is not limited to this, and the post-processing unit 5 may be attached to the printer 2*b*.

(5) In addition, in the above-described embodiment, explanation has been provided that the post-processing unit 5 performs staple processing of stapling recording sheets having been printed by the printer 2*b*. However, the present invention is not limited to this, and the post-processing unit 5 may perform punching processing of punching holes in a recording sheet stack composed of a plurality of recording sheets, instead of performing the stapling processing.

Alternatively, the post-processing unit 5 may be applied to a simple sheet loading device that merely loads multiple sheets transported thereto one by one onto a tray.

Further, the above-described embodiment and each of the modifications above may be combined to the extent possible.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet loading device that includes a tray having a sheet loading surface, that transports a plurality of recording sheets one by one to the tray along a transport path, and that loads the recording sheets one by one onto the sheet loading surface, the sheet loading device comprising:

a guide member configured to be moveable between a first position and a second position, the guide member (i) guiding a recording sheet transported along the transport path to the sheet loading surface when in the first position and (ii) pressing a rear end portion of the recording sheet loaded on the sheet loading surface against the sheet loading surface when in the second position;

a drive member that selectively causes the guide member to move between the first position and the second position;

a restriction member that is arranged between a surface facing the transport path of the guide member in the first position and the sheet loading surface and that is configured to be moveable between a third position and a fourth position, the restriction member (i) restricting the rear end portion from departing from the sheet loading surface and thus preventing the rear end portion from blocking the transport path when in the third position and (ii) releasing the restriction when in the fourth position; and a bias mechanism configured to apply a bias force to bias the restriction member towards the third position from the fourth position, wherein along a course of movement of the guide member from the first position to the second position, the guide member causes the restriction member to move from the third position to the fourth position by an engaging portion of the guide member engaging with an engaged portion of the restriction member, the engagement between the engaging portion and the engaged portion is released before the guide member arrives at the second position, and when the engagement between the engaging portion and the engaged portion is released, the restriction member is caused to return to the third position by the bias force applied by the bias mechanism.

2. The sheet loading device of claim 1, wherein when the restriction member is in the third position, at least a part of the restriction member overlaps with the rear end portion when viewed from a direction perpendicular to a plane including the sheet loading surface.

3. The sheet loading device of claim 2, wherein when the guide member is in the first position and the restriction member is in the third position, a part of the guide member faces the restriction member with the transport path therebetween.

4. The sheet loading device of claim 1, wherein the guide member and the restriction member each include a rotational shaft, the rotational shaft of the guide member and the rotational shaft of the sheet restriction member being parallel to each other, and the guide member moves between the first position and the second position by swinging about an axial center of the rotational shaft of the guide member, and the restriction member moves between the third position and the fourth position by swinging about an axial center of the rotational shaft of the sheet restriction member.

5. The sheet loading device of claim 4, wherein the restriction member includes, as the engaged portion, a lever portion that rotates integrally with the rotational shaft of the restriction member, the lever portion being supported so as to be tiltable in a direction of the axial center of the rotational shaft of the restriction member and having a tapered surface formed at one side, along a course of movement of the guide member from the second position to the first position, the engaging portion of the guide member comes into contact with the tapered surface of the lever portion, and the guide member returns to the first position when the contact between the engaging portion and the lever member is released, the contact being released when the lever portion is caused to tilt in the axial center direction by force in the axial center direction generated by the tapered surface.

6. A post-processing apparatus that is attached to an image forming apparatus and that includes a sheet loading device, the sheet loading device including a tray having a sheet loading surface, transporting a plurality of recording sheets discharged from the image forming apparatus one by one to the tray along a transport path, loading the recording sheets one by one onto the sheet loading surface, and comprising:

a guide member configured to be moveable between a first position and a second position, the guide member (i) guiding a recording sheet transported along the transport path to the sheet loading surface when in the first position and (ii) pressing a rear end portion of the recording sheet loaded on the sheet loading surface against the sheet loading surface when in the second position;

a drive member that selectively causes the guide member to move between the first position and the second position;

a restriction member that is arranged between a surface facing the transport path of the guide member in the first position and the sheet loading surface and that is configured to be moveable between a third position and a fourth position, the restriction member (i) restricting the rear end portion from departing from the sheet loading surface and thus preventing the rear end portion from blocking the transport path when in the third position and (ii) releasing the restriction when in the fourth position; and a bias mechanism configured to apply a bias force to bias the restriction member towards the third position from the fourth position, wherein along a course of movement of the guide member from the first position to the second position, the guide member causes the restriction member to move from the third position to the fourth position by an engaging portion of the guide member engaging with an engaged portion of the restriction member, the engagement between the engaging portion and the engaged portion is released before the guide member arrives at the second position, and when the engagement between the engaging portion and the engaged portion is released, the restriction member is caused to return to the third position by the bias force applied by the bias mechanism.

7. The post-processing apparatus of claim 6, wherein when the restriction member is in the third position, at least a part of the restriction member overlaps with the rear end portion when viewed from a direction perpendicular to a plane including the sheet loading surface.

8. The post-processing apparatus of claim 7, wherein when the guide member is in the first position and the restriction member is in the third position, a part of the guide member faces the restriction member with the transport path therebetween.

9. The post-processing apparatus of claim 6, wherein the guide member and the restriction member each include a rotational shaft, the rotational shaft of the guide member and the rotational shaft of the sheet restriction member being parallel to each other, and the guide member moves between the first position and the second position by swinging about an axial center of the rotational shaft of the guide member, and the restriction member moves between the third position and the fourth position by swinging about an axial center of the rotational shaft of the sheet restriction member.

10. The post-processing apparatus claim 9, wherein the restriction member includes, as the engaged portion, a lever portion that rotates integrally with the rotational shaft of the restriction member, the lever portion being supported so as to be tiltable in a direction of the axial center of the rotational shaft of the restriction member and having a tapered surface formed at one side, along a course of movement of the guide member from the second position to the first position, the engaging portion of the guide member comes into contact with the tapered surface of the lever portion, and the guide member returns to the first position when the contact between the engaging portion and the lever member is released, the contact being released when the lever portion is caused to tilt in the axial center direction by force in the axial center direction generated by the tapered surface.

* * * * *